US009732286B2

(12) United States Patent
Candelon et al.

(10) Patent No.: US 9,732,286 B2
(45) Date of Patent: Aug. 15, 2017

(54) PROCESS FOR HYDROGENATION OF A HYDROCARBON FEEDSTOCK COMPRISING AROMATIC COMPOUNDS

(71) Applicant: AXENS, Rueil Malmaison (FR)

(72) Inventors: Jean-Christophe Candelon, Nanterre (FR); Fabienne Le Peltier, Rueil Malmaison (FR); Annick Pucci, Croissy sur Seine (FR)

(73) Assignee: AXENS, Rueil Malmaison (FR)

( * ) Notice: Subject to any disclaimer, the term of this patent is extended or adjusted under 35 U.S.C. 154(b) by 0 days.

(21) Appl. No.: 14/785,666

(22) PCT Filed: Apr. 10, 2014

(86) PCT No.: PCT/FR2014/050879

§ 371 (c)(1),
(2) Date: Oct. 20, 2015

(87) PCT Pub. No.: WO2014/174178

PCT Pub. Date: Oct. 30, 2014

(65) Prior Publication Data

US 2016/0075955 A1 Mar. 17, 2016

(30) Foreign Application Priority Data

Apr. 26, 2013 (FR) ..... 13 53829
Apr. 9, 2014 (FR) ..... 14 53156

(51) Int. Cl.
*C10G 65/08* (2006.01)
*C10G 45/48* (2006.01)
(Continued)

(52) U.S. Cl.
CPC ..... *C10G 65/08* (2013.01); *C10G 45/48* (2013.01); *C10G 45/50* (2013.01); *C10G 45/52* (2013.01)

(58) Field of Classification Search
CPC ..... C10G 65/08; C10G 65/02; C10G 65/04; C10G 4/48; C10G 4/52
See application file for complete search history.

(56) References Cited

U.S. PATENT DOCUMENTS 8,236,170 B2 8/2012 Reynolds
2009/0134064 A1 5/2009 Reynolds
(Continued)

FOREIGN PATENT DOCUMENTS

EP 0794241 A2 9/1997
GB 834776 A 5/1960

OTHER PUBLICATIONS

International Search Report and Opinion from PCT/FR2014/050879 dated Aug. 22, 2014.

*Primary Examiner* — Michelle Stein
(74) *Attorney, Agent, or Firm* — Millen White Zelano and Branigan, PC; John Sopp; Anthony Zelano

(57) ABSTRACT

Process for hydrogenation of aromatic compounds in a feedstock comprising hydrocarbons having at least five carbon atoms, comprising:

a) contacting feedstock, a hydrogen gas, and a nickel or platinum hydrogenation catalyst at 100 to 400° C., 0.5 to 8 MPa, and a feedstock flow rate 0.5 to 5 $h^{-1}$, as to produce a partially-hydrogenated hydrocarbon feedstock and gas; and b) contacting the partially-hydrogenated feedstock, and a nickel or platinum hydrogenation catalyst at 100 and 400° C., a pressure of between 0.5 and 8 MPa, with a flow rate of the partially-hydrogenated feedstock between 0.3 and 8 $h^{-1}$, a ratio between the volume of hydrogen and the volume of the partially-hydrogenated feedstock between 0.3 and 3 $Nm^3/m^3$, and a ratio between the superficial mass flow rate of the partially- (Continued)

hydrogenated feedstock and the superficial mass flow rate of gas (Ul/Ug) at the inlet of the reactor between 50 and 500.

20 Claims, 1 Drawing Sheet

(51) Int. Cl.
*C10G 45/50* (2006.01)
*C10G 45/52* (2006.01)

(56) References Cited

U.S. PATENT DOCUMENTS

2009/0139898 A1* 6/2009 Long ..... B01J 23/002
208/46
2009/0318739 A1* 12/2009 Liu ..... B01J 23/883
585/276
2012/0004477 A1* 1/2012 Dougherty ..... C10G 45/02
585/240
2012/0004479 A1* 1/2012 Hanks ..... C10G 3/50
585/256

* cited by examiner

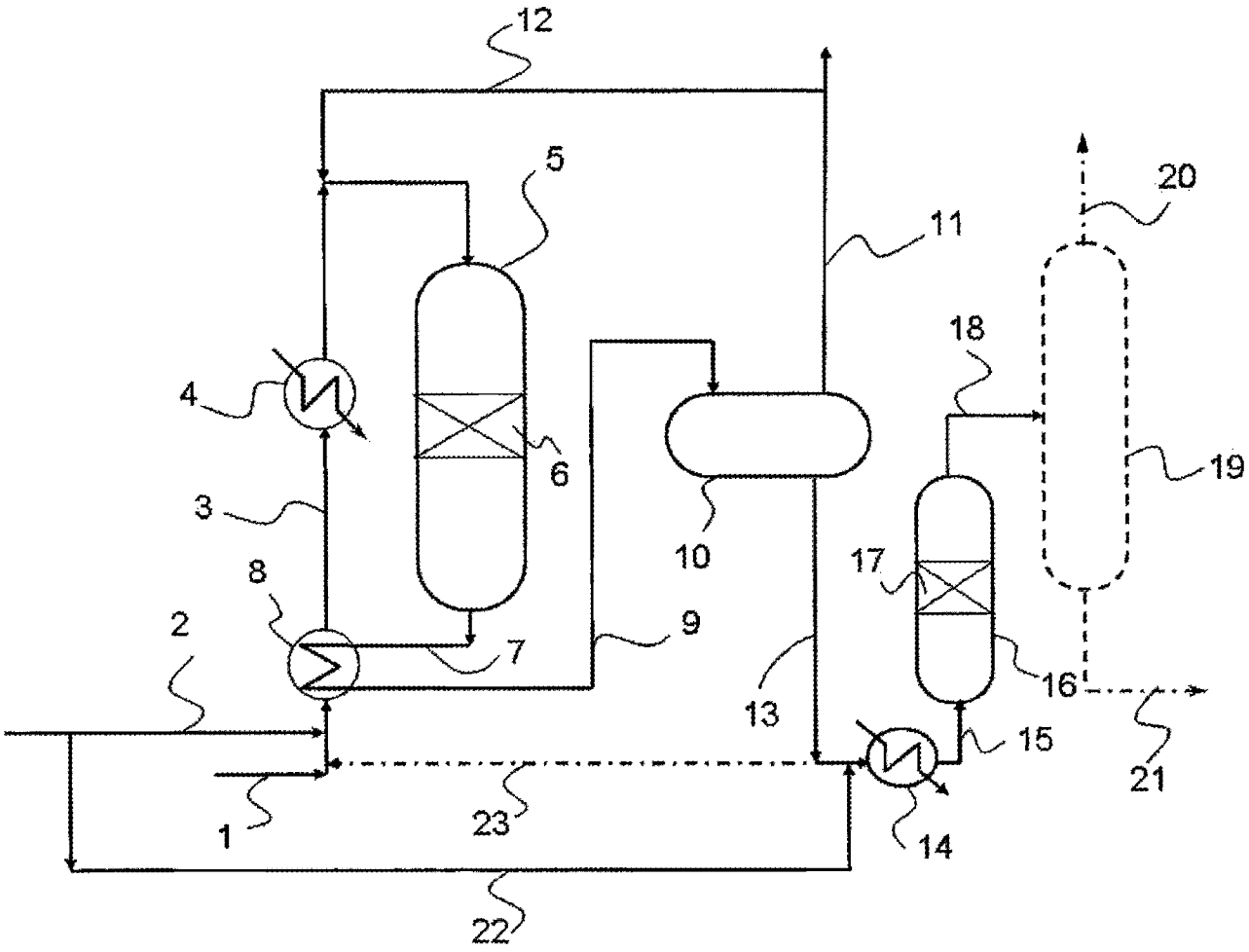
1
2
3
4
5
6
7
8
9
10
11
12
13
14
15
16
17
18
19
20
21
22
23

PROCESS FOR HYDROGENATION OF A HYDROCARBON FEEDSTOCK COMPRISING AROMATIC COMPOUNDS

This invention relates to a process for hydrogenation of aromatic compounds contained in a feedstock comprising hydrocarbons having at least five carbon atoms. The process applies in particular to hydrocarbon feedstocks for the purpose of producing fuels or solvents with low contents of aromatic compounds, in particular benzene.

STATE OF THE ART

Taking into account the recognized toxicity of the aromatic compounds and in particular benzene (C6H6), the general tendency is to reduce the content of these components in fuels (e.g., gasoline) and also in solvents that are used, for example, in dry cleaning, paints, adhesives, or even printing inks.

As far as benzene, which has carcinogenic properties, is concerned, it is required, for example, to limit as much as possible any possibility of polluting the ambient air, in particular by virtually excluding it from automobile fuels. In the United States, the reformulated fuels should not contain more than 0.62% by volume of benzene.

To comply with standards imposed relative to aromatic compounds in hydrocarbons and/or solvents, numerous processes have been developed. For example, the following will be cited:

- The patent GB 1 207 783 that describes a process that makes it possible to separate aromatic hydrocarbons in hydrocarbon-containing fractions by means of at least two extraction stages using solvents;
- The patent GB 1 579 156 that discloses a process for the production of naphthenic solvents consisting in mixing a hydrocarbon-containing fraction having boiling points of between 40° C. and 300° C. with a fraction that is rich in aromatic hydrocarbons so as to obtain a mixture with more than 10% by weight of aromatic compounds, then in hydrogenating this mixture in the presence of a catalyst;
- The U.S. Pat. No. 5,155,084 that describes catalysts based on nickel and magnesium oxide making it possible to carry out the hydrogenation of aromatic compounds in hydrocarbon-containing fractions;
- The U.S. Pat. No. 7,105,712 B2 that relates to a process for hydrogenation of a hydrocarbon feedstock comprising 10 to 80% by volume of aromatic compounds using catalysts based on platinum and palladium deposited on a substrate in which the silica-alumina is dispersed on an alumina;
- The patent EP 0 781 830 B1 that discloses a process that makes it possible to reduce the content of benzene and light unsaturated compounds in hydrocarbon-containing fractions. The process uses a reaction zone for hydrogenation associated with a fractionation column.

One object of the invention is to provide a process for hydrogenation of aromatic compounds contained in a feedstock comprising hydrocarbons having at least five carbon atoms that is simple to implement, while making it possible to comply with specifications in terms of content of aromatic compounds, for example less than 20 ppm by weight.

SUMMARY OF THE INVENTION

This invention therefore relates to a process for hydrogenation of aromatic compounds contained in a feedstock comprising hydrocarbons having at least five carbon atoms, with the process comprising at least the following stages:

a) Said feedstock, a gas stream comprising hydrogen, and a hydrogenation catalyst comprising nickel or platinum dispersed on a substrate are brought into contact in a reactor, with the contact being made at a temperature of between 100 and 400° C., at a pressure of between 0.5 and 8 MPa, and with an hourly volumetric flow rate of the liquid feedstock at the inlet of the reactor of between 0.5 and 5 $h^{-1}$, in such a way as to produce an effluent that comprises a partially-hydrogenated hydrocarbon feedstock and gas;

b) The partially-hydrogenated feedstock that is obtained from stage a) in liquid form, a gas stream comprising hydrogen, and a hydrogenation catalyst comprising nickel or platinum dispersed on a substrate are brought into contact, in a reactor, with the contact being made at a temperature of between 100 and 400° C., at a pressure of between 0.5 and 8 MPa, with an hourly volumetric flow rate of the liquid partially-hydrogenated feedstock of between 0.3 and 8 $h^{-1}$, with a ratio between the volume of hydrogen that is introduced and the volume of the partially-hydrogenated feedstock of between 0.3 and 3 $Nm^3/m^3$, and with a ratio between the superficial mass flow rate of the liquid partially-hydrogenated feedstock and the superficial mass flow rate of gas (Ul/Ug) at the inlet of the reactor of between 50 and 500.

Surprisingly enough, the applicant noted that when the second hydrogenation stage is carried out under the conditions mentioned above, the hydrogenation yield of the aromatic compounds is improved in such a way that it is possible to obtain a hydrocarbon feedstock obtained from this second hydrogenation stage that complies with the specifications of aromatic compounds, e.g., less than 20 ppm by weight, and even preferably less than 10 ppm by weight.

Preferably, the ratio between the superficial mass flow rate of the liquid partially-hydrogenated feedstock and the superficial mass flow rate of gas (Ul/Ug) at the inlet of the reactor is between 60 and 450 and in a more preferred manner between 70 and 300.

Preferably, the superficial mass flow rate of gas comprising hydrogen in stage b) is between 0.001 and 0.1 $kg/(m^2 \cdot s)$.

The substrate of the catalysts of stages a) and b) is preferably selected from among the aluminas, silica, the silica-aluminas, magnesia, titanium oxide, zirconia, the zeolites, by themselves or in a mixture, and it has a specific surface area that is larger than 50 $m^2/g$.

According to a preferred embodiment in which the catalyst of stage b) comprises nickel, stage b) is carried out at a temperature of between 120 and 200° C.

When the catalyst of stage b) comprises nickel, the mean diameter of the nickel particles measured by magnetic granulometry is between 20 angstroms and 80 angstroms and in a more preferred manner between 20 angstroms and 60 angstroms.

According to a preferred embodiment in which the catalyst of stage b) comprises platinum, stage b) is carried out at a temperature of between 200 and 350° C.

When the catalyst of stages a) and/or b) includes nickel, the nickel content is between 15 and 60% by weight of metal nickel relative to the total catalyst weight.

When the catalyst of stages a) and/or b) includes platinum, the platinum content is between 0.05 and 2% by weight of metal platinum relative to the total catalyst weight.

According to a preferred embodiment, the catalysts for hydrogenation of stages a) and b) comprise the same metal that is selected from among nickel and platinum, and the content of nickel or platinum of the catalyst of stage b) is less than that of the catalyst of stage a). According to a preferred embodiment, the contents, expressed in terms of metal nickel or metal platinum, of the catalysts of the first and second stages of hydrogenation are respectively between 40 and 60% by weight and between 15 and 35% by weight relative to the total catalyst weight. In a very preferred manner, the contents, expressed in terms of metal nickel or metal platinum, of the catalysts of the first and second stages of hydrogenation are respectively between 40 and 50% by weight and between 25 and 35% by weight relative to the total catalyst weight.

Preferably, the catalysts of stages a) and/or b) also comprise at least one metal that is selected from among palladium, iridium, molybdenum, and tungsten.

The content of palladium or iridium, expressed in terms of metal palladium or metal iridium, is generally between 0.05 and 2% by weight relative to the total catalyst weight.

The content of molybdenum or tungsten, expressed in terms of oxide, is generally between 0.5 and 10% by weight relative to the total catalyst weight.

According to a complementary embodiment, an intermediate stage for separation of the liquid and gas from the effluent obtained from stage a) is carried out, and the liquid fraction that is obtained from the intermediate separation is treated in stage b).

Alternatively, a stage for intermediate distillation of the partially-hydrogenated feedstock that is obtained from stage a) or obtained from the separation stage is carried out in such a way as to separate a first fraction that has a boiling point between the boiling point of the hydrocarbons with five carbon atoms and $T_x$° C. and a second fraction that has a boiling point that is higher than $T_x$° C., with $T_x$ between 150 and 250° C., and next the second fraction is treated in stage b). Thus, the process according to the invention makes it possible to treat only one fraction (or hydrocarbon fraction) that constitutes the partially-hydrogenated feedstock that is produced in the hydrogenation stage a). Preferably, the fraction that is hydrogenated in stage b) corresponds to a fraction that contains a major portion of the aromatic compounds that have not been hydrogenated during stage a).

According to the invention, the treated feedstock can be selected from among a light naphtha fraction, a heavy naphtha fraction, a desulfurized complete naphtha fraction, a raffinate from a unit for extraction of aromatic compounds, a raffinate from dewaxing units, a kerosene fraction, a desulfurized diesel fuel fraction, or a catalytic reforming gasoline.

DETAILED DESCRIPTION OF THE INVENTION

The Hydrocarbon Feedstock

The process according to the invention is a process that makes it possible to reduce the content of aromatic compounds and optionally of unsaturated compounds such as monoolefins in hydrocarbon-containing feedstocks comprising more than 5 carbon atoms and up to 70% by weight of aromatic compounds.

Generally, the hydrocarbon feedstock has an initial boiling point corresponding to C5 hydrocarbons up to a final point of approximately 360° C. (measured according to the standard ASTM D86). Preferably, the hydrocarbon feedstock that is treated by the process according to the invention is a hydrocarbon feedstock comprising 5 to 20 carbon atoms.

By way of example, the treated feedstock can be selected from among a desulfurized light naphtha fraction containing benzene and toluene; a heavy naphtha fraction containing toluene, xylene, and optionally aromatic compounds with 9 or 10 carbon atoms; a complete naphtha fraction (full-range naphtha according to English terminology); a raffinate from a unit for extracting aromatic compounds; a raffinate from dewaxing units; a kerosene fraction; a desulfurized diesel fuel fraction that is obtained from direct distillation or a process for cracking (FCC) or coking; or a catalytic reforming gasoline.

The feedstocks that can be treated by the process have high contents of aromatic compounds, typically on the order of 30% by weight, and even up to 70% by weight. By way of example, the aromatic compounds that are hydrogenated by means of the process according to the invention are: benzene, toluene, xylene, aromatic polycyclic compounds such as naphthalene, anthracene, and derivatives thereof.

The First Hydrogenation Stage (Stage a)

The purpose of the first stage is to reduce the content of aromatic compounds of the hydrocarbon feedstock to a content that is less than 1,000 ppm by weight, and even less than 300 ppm, and preferably less than 100 ppm by weight.

This first stage consists in bringing into contact, in a reactor, the feedstock that is to be treated with a gas that contains hydrogen in the presence of a hydrogenation catalyst. The gas that is used preferably contains between 50% and 100% by volume of hydrogen ($H_2$), and in a more preferred manner between 80 and 100% by volume of hydrogen.

The reactor that is used for carrying out the first hydrogenation stage a) can be of the fixed-bed type in an upward or downward flow, in a mixed liquid/gas phase, or in vapor phase.

The first hydrogenation stage is generally performed at a weighted average temperature of the catalytic bed (WABT or Weighted Average Bed Temperature according to English terminology) that is generally between 100° C. and 400° C., preferably between 120° C. and 200° C., and even between 120° C. and 170° C., with temperature fluctuations in the catalytic bed that are less than 50° C.

The hydrocarbon feedstock in liquid form is sent into the reactor with an hourly volumetric flow rate of the liquid (L.H.S.V. or Liquid Hourly Space Velocity according to English terminology) at the inlet of said reactor that is generally between 0.5 and 5 liters of liquid feedstock per liter of catalyst and per hour (liter of feedstock/(liter of catalyst·hour) or $h^{-1}$), preferably between 0.8 and 4 $h^{-1}$. The pressure that is used in the reactor for this stage is generally between 0.5 and 8 MPa, preferably between, encompassed between, 1.5 and 5 MPa.

The catalyst that is used in this stage a) is based on nickel or platinum, dispersed on a porous substrate.

According to a preferred embodiment, the content of nickel, expressed in terms of metal Ni relative to the total catalyst weight, is between 15 and 60% by weight, preferably between 25 and 50% by weight.

When the catalyst of stage a) comprises platinum, the platinum content, expressed in terms of metal Pt relative to the total catalyst weight, is generally between 0.05 and 2% by weight, preferably between 0.1 and 1% by weight, and in a more preferred manner between 0.1 and 0.5% by weight.

According to a preferred embodiment, the hydrogenation catalyst comprising nickel or platinum also includes at least one so-called "promoter" metal that is selected from among palladium, iridium, molybdenum and tungsten. When the "promoter" metal is palladium or iridium, it is for the most part (i.e., at least 80% by weight, preferably at least 90% by weight of said metal) in metallic form in the catalyst. The content of palladium or iridium, expressed in terms of metal, is generally between 0.05 and 2% by weight and in a preferred manner between 0.2 and 1% by weight, relative to the total catalyst weight.

In the case where the "promoter" metal is molybdenum or tungsten, it is for the most part (i.e., at least 80% by weight, preferably at least 90% by weight of said metal) in oxide form in the catalyst. The content of molybdenum or tungsten, expressed in terms of oxide, is generally between 0.5 and 10% by weight, in a preferred manner between 1 and 8% by weight, and in an even more preferred manner between 2 and 5% by weight, relative to the total catalyst weight.

Any type of substrate that makes it possible to disperse the metals can be used. Said substrate can be, for example, an alumina, silica, a silica-alumina, magnesia, titanium oxide, zirconia, a zeolite, by themselves or in a mixture. It is possible to use substrates with a different nature or different characteristics in the hydrogenation stages of the process according to the invention. Preferably, the substrates that are used have a specific surface area that is larger than 50 $m^2/g$ and in a more preferred manner between 70 $m^2/g$ and 600 $m^2/g$. In an even more preferred manner, the specific surface area is between 100 $m^2/g$ and 400 $m^2/g$. The catalysts that are used in the invention can be prepared by means of any technique that is known to one skilled in the art, for example by means of excess solution impregnations, dry impregnations, or co-mixing.

Finally, the $H_2$/feedstock volumetric ratio (between the volume of hydrogen introduced and the volume of feedstock) in the reactor is generally between 50 and 2000 $Nm^3/m^3$, preferably between 100 and 1000 $Nm^3/m^3$, and in a more preferred manner between 150 and 800 $Nm^3/m^3$.

Based on the temperature and pressure conditions encountered in the hydrogenation reactor, the treated hydrocarbon feedstock can be either in the liquid phase or in the gaseous phase within said reactor for hydrogenation of stage a).

If the feedstock is in liquid form, the hydrogenation reactor can be operated with a feedstock in upward flow ("upflow" mode according to English terminology) or in downward flow ("downflow" mode according to English terminology). Preferably, the first stage for hydrogenation of the liquid hydrocarbon feedstock is conducted in downward flow while the stream of gas containing hydrogen is sent either in co-current or in counter-current of said liquid hydrocarbon feedstock.

Generally, the hydrodynamic conditions of the first stage at the inlet of the reactor are as follows:

The ratio of the superficial mass flow rates of liquid hydrocarbon feedstocks and the gas, Ul/Ug, is greater than 500, preferably greater than 700. The superficial gas flow rates Ug or Ul of the gas or liquid are calculated by the following formula Ux ($kg/(m^2 \cdot s)$) =flow rate of the fluid (in kg/s)/cross-section of the reactor ($m^2$).

The superficial mass flow rate of the gas (Ug) is preferably between 0.001 and 0.1 $kg/(m^2 \cdot s)$, in a more preferred manner between 0.005 and 0.05 $kg/(m^2 \cdot s)$.

Generally, the Ul/Ug ratio is fixed by making the parameter Ug vary, because the value Ul is conditioned by the flow rate of the feedstock to be treated that is introduced into the reactor.

During this first stage, at least partial hydrogenation of the aromatic compounds and olefins optionally present in the feedstock is carried out in such a way as to produce a so-called "partially-hydrogenated" feedstock that has a content of aromatic compounds that is less than 1,000 ppm by weight, preferably less than 300 ppm by weight, and in an even more preferred manner less than 100 ppm by weight.

At the end of the hydrogenation stage a), an effluent is recovered that comprises the hydrocarbon feedstock, which is low in aromatic compounds and which is either in liquid form or in gaseous form, in a mixture with a gas comprising the hydrogen that has not reacted.

According to the invention, if the effluent that is obtained from the hydrogenation stage a) is in gaseous form, a condensation stage is initiated during which said effluent is cooled so as to obtain a hydrocarbon feedstock that is low in aromatic compounds in the form of liquid mixed with hydrogen.

According to a preferred mode, before the second hydrogenation stage b), the process according to the invention also comprises a separation stage that is carried out on the effluent that is obtained from the first hydrogenation stage a) and optionally after the condensation stage mentioned above so as to separate the hydrogen that has not reacted. This separation makes it possible to recover a liquid partially-hydrogenated hydrocarbon feedstock, low in aromatic compounds and in hydrogen, which is next treated in the second hydrogenation stage b). For example, the liquid and the gas constituting the effluent of the first hydrogenation reactor are separated in a liquid/gas separator such as, for example, a flash tank (flash drum according to English terminology).

According to an alternative embodiment, the effluent that is obtained from the first hydrogenation reactor is separated into at least two liquid hydrocarbon fractions: a first fraction (or light fraction) that has a boiling point of between the boiling point of hydrocarbons with five carbon atoms and $T_x$° C., and a second fraction (or heavy fraction) that has a boiling point of higher than $T_x$° C., with $T_x$ generally between 150 and 250° C. Next, the second fraction (heavy fraction) is treated in the second hydrogenation stage b) according to the invention. The temperature $T_x$ is adjusted to attain the specification of aromatic compounds of the light fraction based on the type of solvent desired and its final use. By a simple distillation stage, it is possible to recover—at the top of the column—a hydrocarbon fraction with a low content of aromatic compounds and—at the bottom of the column—a heavy hydrocarbon fraction that contains the major portion of residual aromatic compounds that are the most recalcitrant in hydrogenation.

The Second Stage of Hydrogenation (Stage b)

The purpose of the second stage is to reduce the content of aromatic compounds of the hydrocarbon feedstock that is partially-hydrogenated and low in aromatic compounds to a value that is less than 20 ppm by weight, and even less than 10 ppm by weight.

This second catalytic hydrogenation stage is conducted in a reactor in which the hydrocarbon feedstock in liquid form and optionally containing dissolved hydrogen, obtained from the first stage a), is brought into contact with a gas comprising hydrogen and in the presence of a hydrogenation catalyst. As in the case of the hydrogenation stage a), the gas that is used preferably contains between 50% and 100% by volume of hydrogen ($H_2$), in a more preferred manner between 80 and 100% by volume of hydrogen.

Within the framework of the invention, the second hydrogenation stage b) can be performed in the same reactor as the one of the first hydrogenation stage. In this case, the process uses a single reactor in which two catalyst beds are successively arranged to carry out successively the first and second hydrogenation reactions.

In this embodiment and when the hydrocarbon feedstock that is treated in the first hydrogenation stage is in gaseous form, a cooling zone that is internal or external to the reactor is provided so as to condense the partially-hydrogenated hydrocarbon feedstock in liquid form before the latter is brought into contact with the second hydrogenation catalyst of the second stage b). If the cooling zone is arranged in the reactor, the latter is located between the two catalytic beds. In the case where said cooling zone is external to the reactor, means for drawing-off the effluent that are arranged downstream from the first catalytic bed and means for recirculating the condensed effluent that are arranged upstream from the second catalytic bed are provided.

The catalyst that is used for this second hydrogenation stage has characteristics that are similar to those of the first hydrogenation stage. Thus, the hydrogenation catalyst is based on nickel or platinum, dispersed on a porous substrate. The nickel content, expressed in terms of metal Ni, relative to the total catalyst weight, is between 15 and 60% by weight, preferably between 25 and 50% by weight, relative to the total catalyst weight.

When the catalyst of stage b) comprises platinum, the platinum content, expressed in terms of metal Pt relative to the total catalyst weight, is generally between 0.05 and 2% by weight, preferably between 0.1 and 1% by weight, and in a more preferred manner between 0.1 and 0.5% by weight. According to a preferred embodiment, the hydrogenation catalyst of stage b) comprising nickel or platinum also includes at least one so-called "promoter" metal that is selected from among palladium, iridium, molybdenum, and tungsten. When the "promoter" metal is palladium or iridium, it is in metallic form in the catalyst. The content of palladium or iridium, expressed in terms of metal, is generally between 0.05 and 2% by weight, and in a preferred manner between 0.2 and 1% by weight, relative to the total catalyst weight.

In the case where the "promoter" metal is molybdenum or tungsten, it is in oxide form in the catalyst. The content of molybdenum or tungsten, expressed in terms of oxide, is generally between 0.5 and 10% by weight, in a preferred manner between 1 and 8% by weight, and in an even more preferred manner between 2 and 5% by weight, relative to the total catalyst weight.

When nickel is used in the second hydrogenation stage, the mean diameter of the nickel particles, measured by magnetic method, is preferably between 20 angstroms and 80 angstroms, and in a more preferred manner between 20 angstroms and 60 angstroms.

The determination of the mean diameter of the nickel particles is done by using the magnetic properties of nickel. During magnetic measurements in the weak fields, the increase in the magnetization with the magnetic field is for the most part due to large particles. Conversely, in the strong fields, it is for the most part due to small particles. It is therefore possible to determine the mean diameter of the small particles "d" and the large particles "D" by being placed in these two domains of magnetic fields and by using the simplified forms of the Langevin equations with boundary values of the fields. The mean diameter of the nickel particles is then calculated from the mean of these two values: Dm=(d+D)/2. The detail of this method for determination is described in the publication by M. PRIMET, J. A. DALMON, and G. A. MARTIN, Journal of Catalysis 46, pages 25 to 36, 1977.

Any type of substrate making it possible to disperse the metals can be used. Said substrate can be, for example, an alumina, silica, a silica-alumina, magnesia, titanium oxide, zirconia, a zeolite, by themselves or in a mixture. Preferably, the substrates that are used have a specific surface area that is greater than 50 $m^2/g$ and in a more preferred manner between 70 $m^2/g$ and 600 $m^2/g$. In an even more preferred manner, the specific surface area is between 100 $m^2/g$ and 400 $m^2/g$. The catalysts that are used in the invention can be prepared by means of any technique that is known to one skilled in the art, for example by means of excess solution impregnations, dry impregnations, or co-mixing.

The contact in the second hydrogenation stage b) is generally carried out:

At a temperature of between 100 and 400° C.;

At a pressure of between 0.5 and 8 MPa;

With an hourly volumetric flow rate of the liquid (L.H.S.V. or Liquid Hourly Space Velocity according to English terminology) of between 0.3 and 8 $h^{-1}$;

With a ratio between the volume of hydrogen that is introduced and the volume of the feedstock in the second stage of between 0.3 and 3 $Nm^3/m^3$.

Preferably, when the catalyst that is used is based on nickel, the second hydrogenation stage is performed with a weighted average temperature of the catalytic bed (WABT or Weighted Average Bed Temperature according to English terminology) that is generally between 100° C. and 300° C., preferably between 120° C. and 200° C., with temperature fluctuations in the catalytic bed that are less than 10° C., preferably less than 5° C., and in a more preferred manner less than 2° C. The pressure that is used is preferably between 0.5 and 5 MPa, in a more preferred manner between 1.2 and 3 MPa, and the hourly volumetric flow rate of the liquid is preferably between 0.5 and 6 $h^{-1}$. The $H_2$/feedstock ratio between the volume of hydrogen that is introduced and the volume of feedstock is preferably between 0.3 and 3 $Nm^3/m^3$, and in a more preferred manner between 0.8 and 2 $Nm^3/m^3$.

When the catalyst that is used is based on platinum, the second hydrogenation stage is preferably performed with a weighted average temperature of the catalytic bed (WABT or Weighted Average Bed Temperature according to English terminology) of between 200° C. and 350° C. with temperature fluctuations in the catalytic bed that are less than 10° C., preferably less than 5° C., and in a more preferred manner less than 2° C. The pressure that is used is generally between 1.5 and 8 MPa, preferably between 3 and 6 MPa. The hourly volumetric flow rate of the liquid is generally between 0.3 and 8 liters of liquid feedstock per liter of catalyst and per hour (liter of feedstock/(liter of catalyst·hour) or $h^{-1}$), preferably between 0.5 and 6 $h^{-1}$. The $H_2$/feedstock ratio between the volume of hydrogen that is introduced and the volume of feedstock is generally between 0.3 and 3 $Nm^3/m^3$, preferably between 0.3 and 2.5 $Nm^3/m^3$, and in a more preferred manner between 0.8 and 2 $Nm^3/m^3$.

According to the invention, this second stage is conducted by complying with the following hydrodynamic conditions:

The ratio of the superficial mass flow rates of liquid and gas, Ul/Ug of between 50 and 500, preferably between 60 and 450, in a more preferred manner between 70 and 300, with the superficial mass flow rates Ug or Ul of the gas or liquid that are calculated by the following formula:

$$Ux\ (kg/(m^2 \cdot s)) = \text{flow rate of fluid (in kg/s)/cross-section of the reactor } (m^2).$$

The superficial mass flow rate of the gas (Ug) is preferably between 0.001 and 0.1 $kg/(m^2 \cdot s)$, in a more preferred manner between 0.001 and 0.08 $kg/(m^2 \cdot s)$, and in a very preferred manner between 0.005 and 0.07 $kg/(m^2 \cdot s)$.

As mentioned above with reference to the first hydrogenation stage, the Ul/Ug ratio is fixed by making the parameter Ug vary because the value Ul is conditioned by the flow rate of the feedstock to be treated that is introduced into the reactor.

When the second hydrogenation stage is carried out in a second dedicated reactor, it can be performed with the liquid partially-hydrogenated hydrocarbon feedstock in upward flow ("upflow" mode according to English terminology) or in downward flow ("downflow" mode according to English terminology).

According to a preferred embodiment using two reactors for carrying out the two stages, the process according to the invention is performed with a liquid feedstock in downward flow (downflow) relative to the first hydrogenation reactor and in an upward flow (upflow) for the second hydrogenation reactor.

Within the framework of the invention, it is possible to use identical or different hydrogenation catalysts in the two stages a) and b).

According to a preferred embodiment of the process, the stages a) and b) use hydrogenation catalysts that have the same metal (nickel or platinum) and with the metal content of the catalyst of stage b) that is less than that of the catalyst of stage a).

BRIEF DESCRIPTION OF THE FIGURE

The FIGURE below exhibits an advantageous embodiment of the process according to the invention.

With reference to the FIGURE, the liquid hydrocarbon feedstock containing aromatic compounds is brought in via the pipes 1, 3 into a first hydrogenation reactor 5 so as to carry out stage a) of the process. The feedstock, before its introduction into the reactor 5, is mixed with a gas that comprises the hydrogen that is provided via the line 2.

The mixture is then preheated by means of a heat exchanger 8, which is, for example, supplied by the hot effluent that is obtained from the first hydrogenation reactor 5. The preheated mixture is next heated, by means of a vapor exchanger 4, to the necessary temperature for carrying out hydrogenation.

As indicated in the FIGURE, the liquid hydrocarbon feedstock comprising hydrogen and heated is sent into the reactor 5 according to an operating mode in downward flow (the feedstock being introduced at the top of the reactor). Within the framework of the invention, it is possible, however, to use an operating mode in upward flow for the liquid hydrocarbon feedstock in a mixture with hydrogen.

The first reactor 5 comprises a hydrogenation catalyst bed based on nickel or platinum dispersed on a substrate. The catalyst, in the presence of hydrogen, makes possible the at least partial conversion of the aromatic compounds into their saturated equivalent compounds. For example, the benzene is converted into cyclohexane.

In the case where the hydrocarbon feedstock comprises monosaturated compounds (e.g., olefins), or polyunsaturated compounds (e.g., dioefins), the latter are also hydrogenated in their corresponding alkanes.

The hydrogenation reaction consists of bringing reagents into contact with the hydrogenation catalyst. Thus, in this first hydrogenation stage, the hydrocarbon feedstock inside the reactor can be either in the liquid phase or in the vapor phase. Preferably, the temperature and pressure conditions are regulated in such a way that the hydrocarbon feedstock is in liquid form.

As shown in the FIGURE, the effluent comprising the partially-hydrogenated hydrocarbon feedstock, i.e., whose aromatic compound content has been reduced, in a mixture with hydrogen that has not reacted, is drawn off from the reactor 5 via the line 7. Preferably, the first hydrogenation stage makes it possible to provide a hydrogenated feedstock that has an aromatic compound content of less than 1,000 ppm by weight, preferably less than 150 ppm by weight.

The effluent is cooled by means of the heat exchanger 8 in which the heat is exchanged with the hydrocarbon feedstock that is to be treated, before being sent via the line 9 into a liquid/gas separation device 10, such as, for example, a flash drum. This device makes it possible to separate a gaseous fraction that contains hydrogen that has not reacted in the first stage and a liquid fraction comprising the partially-hydrogenated hydrocarbon feedstock.

Alternatively, the liquid/gas separation device can be replaced by a distillation column (not shown) that is designed so as to carry out a fractionation of the effluent into two light and heavy fractions as described above. According to this alternative and to the extent that the light fraction corresponds to specifications of aromatic compounds, only the heavy fraction is next treated by itself in the second hydrogenation stage of stage b).

With reference to the FIGURE, the gaseous fraction containing hydrogen is drawn off from the liquid/gas separation device 10 via the line 11 and is optionally recycled in the hydrogenation reactor 5 via the line 12.

The liquid fraction comprising the hydrocarbon feedstock that is partially-hydrogenated and low in hydrogen is drawn off via the line 13. All or a portion of the liquid fraction is sent, after heating by means of the heat exchanger 14, via the line 15 into the hydrogenation reactor 16 of the second stage b). The hydrogenation reactor 16 comprises a catalyst bed 17 based on nickel or platinum dispersed on a substrate as described above. An addition of hydrogen is also provided via the line 22 so as to carry out the second hydrogenation stage.

According to the invention, this second hydrogenation stage consists in bringing the liquid feedstock or a fraction (or hydrocarbon fraction) constituting the feedstock that is obtained from stage a) of the hydrogen into contact with a hydrogenation catalyst.

This second stage also complies with the following hydrodynamic conditions: the ratio of the superficial mass flow rates of liquid and gas, Ul/Ug is between 50 and 500, preferably between 60 and 450, and in a more preferred manner between 70 and 300, with the superficial mass flow rates Ug or Ul of the gas or liquid that are calculated by the following formula Ux (kg/(m$^2$·s))=flow rate of the fluid (in kg/s)/cross-section of the reactor (m$^2$).

Preferably, the superficial mass flow rate of the gas (Ug) is preferably between 0.001 and 0.1 kg/(m$^2$·s), in a more preferred manner between 0.001 and 0.08 kg/(m$^2$·s), and in a very preferred manner between 0.005 and 0.07 kg/(m$^2$·s).

As indicated in the FIGURE, the hydrocarbon feedstock that is hydrogenated and that has an aromatic compound content that is less than 30 ppm by weight, preferably less than 20 ppm by weight, and in a more preferred manner less than 10 ppm by weight is drawn off via the line 18.

According to an alternative embodiment that is also shown in the FIGURE, the hydrogenated hydrocarbon feedstock that is obtained from stage b) is sent into a separation unit, for example a distillation column 19 or splitter (according to English terminology) that is designed and operated in such a way as to extract:

At the top of the column 19, via the line 20, a hydrocarbon fraction that has, for example, a boiling point of between the boiling point of the hydrocarbons with five carbon atoms and $T_x$° C., and;

At the bottom of the column 19, via the line 21, a hydrocarbon fraction that has a boiling point of higher than $T_x$° C., with $T_x$ generally between 150 and 250° C.

The two fractions that are thus extracted from the distillation column 19 can be used as a base for the production of solvents corresponding to the specifications of aromatic compounds.

EXAMPLES

In the following examples, a process is carried out with two stages for hydrogenation on catalysts based on nickel supported on alumina.

These catalysts have been prepared by means of two successive dry impregnations. The impregnation method consists in using the ammoniacal method described in the U.S. Pat. No. 4,490,480.

For each of the impregnation stages, an aqueous solution that contains nickel bicarbonate and ammonia, with a pH of 10.5 and heated to 50° C., is prepared so as to form the complex $Ni(NH_3)_6CO_3$ in solution. This solution is impregnated on the extruded alumina substrate, and then the temperature of the batch is brought within 2 hours to 90° C. and maintained for 3 hours at this temperature, which brings about the gradual decomposition of the complex and the precipitation of a nickel compound in the pores of the alumina.

The impregnated precursor that is obtained is dried at 100° C. for 5 hours, and then calcined at 400° C. for 1 hour after each of the two impregnation stages.

The catalyst that is used in the first hydrogenation stage a) comprises 35% by weight of nickel deposited on the cubic gamma-alumina in the form of extrudates whose surface is 185 $m^2/g$ before deposition of the nickel.

The catalyst of the second hydrogenation stage b) comprises 27% by weight of nickel deposited on the same cubic gamma-alumina. The nickel particles have a mean diameter determined by magnetism of 52 angstroms.

The hydrocarbon feedstock that is used has the composition described in Table 1. This feedstock was hydrotreated in advance to remove the nitrogen-containing, chlorinated and sulfur-containing compounds; it contains less than 1 ppm by weight of sulfur, less than 1 ppm by weight of nitrogen, and less than 0.1 ppm by weight of chlorine.

The feedstock that is to be treated is sent into the first hydrogenation stage a) under the following operating conditions:

The reactor operates in a downward flow mode (downflow);

Average temperature of the bed (WABT): 160° C.;

Pressure: 1.8 MPa;

L.H.S.V.: 1 $h^{-1}$;

A gas containing 95% by volume of hydrogen is introduced into the reactor with an $H_2$/feedstock ratio by volume of 500 $Nm^3/m^3$;

Ul/Ug ratio=800;

The exotherm of the reactor is controlled by means of a recycling of the cooled liquid effluent.

The operating conditions used in the second hydrogenation stage b) are as follows:

The reactor is operated in the upward flow mode (upflow);

Average temperature of the bed (WABT): 160° C.;

Pressure: 1.8 MPa;

L.H.S.V.: 1 $h^{-1}$

A separation of the liquid and gas is carried out by cooling on the effluent that is obtained from the first hydrogenation stage a), and the thus separated liquid is sent into the second hydrogenation stage b). The separation column that is used comprises between 30 plates and is operated with a pressure of 0.7 MPa at the top of the column and with a bottom temperature of 320° C.

Example 1 (According to the Invention)

The second hydrogenation stage is operated under the following hydrodynamic conditions at the inlet of the reactor:

Ug=0.02 kg/($m^2$s) and

Ul/Ug=150.

A gas that contains 99.9 mol % of hydrogen is introduced into the reactor with an $H_2$/feedstock ratio in a volume of 1 $Nm^3/m^3$.

Table 1 below summarizes the composition of the hydrocarbon feedstock that has an initial boiling point of 220° C. and a final point of 350° C. and the composition of the effluents that are obtained.

TABLE 1

| Compounds | Content (% by Weight) | Gaseous Phase After the 1st Hydrogenation Stage (% by Volume) | Liquid Phase After the 1st Hydrogenation Stage and Separation (% or ppm by Weight) | Effluent Obtained from the 2nd Hydrogenation Stage (% or ppm by Weight) |
|---|---|---|---|---|
| Paraffins | 53 | 3 | 54 | 54 |
| Olefins | <1 | — | 0 | 0 |
| Naphthenes | 16 | — | 46 | 46 |
| Aromatic Compounds | 30 | — | 300 ppm | 8 ppm |
| Total | 100 | 100 | 100 | 100 |

Thus, the process according to the invention makes it possible to produce an effluent that is obtained from the second hydrogenation stage that has a content of aromatic compounds that is less than 10 ppm by weight, thus corresponding to the requirement of hydrocarbons with a low content of aromatic compounds, in particular in applications such as solvents.

Example 2 (Comparative)

The second hydrogenation stage b) is performed under the following hydrodynamic conditions:

At the inlet of the reactor: Ug=0.003 kg/($m^2$s) and Ul/Ug=700 (outside of the invention).

The hydrogen is introduced into the reactor with an $H_2$/feedstock ratio by volume of 0.5 $Nm^3/m^3$.

Table 2 below summarizes the results that are obtained:

TABLE 2

| Compounds | Liquid Phase After the 1st Hydrogenation Stage and Separation (% or ppm by Weight) | Effluent Obtained from the 2nd Hydrogenation Stage (% or ppm by Weight) |
|---|---|---|
| Paraffins | 54 | 54 |
| Olefins | 0 | 0 |
| Naphthenes | 46 | 46 |
| Aromatic Compounds | 300 ppm | 260 ppm |
| Total | 100 | 100 |

It is noted that when the Ul/Ug ratio of stage b) is equal to 700, beyond the range 50-500, the effluent that is obtained after this second hydrogenation stage has a content of aromatic compounds that is considerably higher than the targeted value of 10 ppm by weight.

Example 3 (Comparative)

The process of Example 1 is carried out under the conditions described above with the exception that the second hydrogenation stage b) is performed under the following hydrodynamic conditions:

At the inlet of the reactor: Ug=0.07 kg/m$^2$s and Ul/Ug=30 (outside of the invention).

Hydrogen is introduced into the reactor with an H2/feedstock ratio by volume of 6 Nm$^3$/m$^3$.

Table 3 below summarizes the results that are obtained.

TABLE 3

| Compounds | Liquid Phase After the 1$^{st}$ Hydrogenation Stage and Separation (% or ppm by Weight) | Effluent Obtained from the 2$^{nd}$ Hydrogenation Stage (% or ppm by Weight) |
|---|---|---|
| Paraffins | 54 | 54 |
| Olefins | 0 | 0 |
| Naphthenes | 46 | 46 |
| Aromatic Compounds | 300 ppm | 79 ppm |
| Total | 100 | 100 |

It is noted that when the Ul/Ug ratio of stage b) is equal to 30, beyond the range 50-500, the effluent that is obtained after this second hydrogenation stage has a content of aromatic compounds that is considerably higher than the targeted value of 10 ppm by weight.

Example 4 (Comparative)

The second hydrogenation stage b) is performed under the following hydrodynamic conditions:

At the inlet of the reactor: Ug=0.3 kg/m$^2$s and Ul/Ug=10 (outside of the invention).

Hydrogen is introduced into the reactor with an H2/feedstock ratio in a volume of 12 Nm$^3$/m$^3$.

Table 4 below summarizes the results that are obtained.

TABLE 4

| Compounds | Liquid Phase After the 1$^{st}$ Hydrogenation Stage and Separation (% or ppm by Weight) | Effluent Obtained from the 2$^{nd}$ Hydrogenation Stage (% or ppm by Weight) |
|---|---|---|
| Paraffins | 54 | 54 |
| Olefins | 0 | 0 |
| Naphthenes | 46 | 46 |
| Aromatic Compounds | 300 ppm | 79 ppm |
| Total | 100 | 100 |

Again, it is observed that when the Ul/Ug ratio of stage b) is equal to 10, beyond the range 50-500, the effluent that is obtained after this second hydrogenation stage has a content of aromatic compounds that is greater than the specification of 10 ppm by weight.

The invention claimed is:

1. Process for hydrogenation of aromatic compounds contained in a feedstock comprising hydrocarbons having at least five carbon atoms, with the process comprising at least the following stages:

a) bringing said feedstock, a gas stream comprising hydrogen, and a hydrogenation catalyst comprising nickel or platinum dispersed on a substrate into contact in a reactor, with the contact being made at a temperature of between 100 and 400° C., at a pressure of between 0.5 and 8 MPa, and with an hourly volumetric flow rate of the liquid feedstock at the inlet of the reactor of between 0.5 and 5 h$^{-1}$, in such a way as to reduce the content of aromatic compounds by hydrogenation and produce an effluent comprising a partially-hydrogenated hydrocarbon feedstock having a content of aromatic compounds that is less than 1,000 ppm and a gas; and b) bringing the partially-hydrogenated feedstock that is obtained from stage a) in liquid form, a gas stream comprising hydrogen, and a hydrogenation catalyst comprising nickel or platinum dispersed on a substrate into contact in a reactor, with the contact being made at a temperature of between 100 and 400° C., at a pressure of between 0.5 and 8 MPa, with an hourly volumetric flow rate of the liquid partially-hydrogenated feedstock of between 0.3 and 8 h$^{-1}$, with a ratio between the volume of hydrogen that is introduced and the volume of the partially-hydrogenated feedstock of between 0.3 and 3 Nm$^3$/m$^3$, and with a ratio between the superficial mass flow rate of the liquid partially-hydrogenated feedstock and the superficial mass flow rate of gas (Ul/Ug) at the inlet of the reactor of between 50 and 500.

2. Process according to claim 1, in which the ratio between the superficial mass flow rate of the liquid partially-hydrogenated feedstock and the superficial mass flow rate of gas (Ul/Ug) at the inlet of the reactor is between 60 and 450.

3. Process according to claim 1, in which in stage b), the superficial mass flow rate of gas comprising hydrogen is between 0.001 and 0.1 kg/(m$^2$s).

4. Process according to claim 1, in which in stage a), the ratio between the superficial mass flow rate of the liquid feedstock that is to be treated and the superficial mass flow rate of gas (Ul/Ug) at the inlet of the reactor is higher than 500.

5. Process according to claim 1, in which the substrate of the catalysts of stages a) and b) is selected from among aluminas, silica, silica-aluminas, magnesia, titanium oxide, zirconia, zeolites, by themselves or in a mixture, and it has a specific surface area that is greater than 50 m$^2$/g.

6. Process according to claim 1, in which when the catalyst of stage b) comprises nickel, said stage b) is carried out at a temperature of between 120 and 200° C.

7. Process according to claim 1, in which the catalyst of stage b) comprises nickel, and the mean diameter of the nickel particles measured by magnetic granulometry is between 20 angstroms and 80 angstroms.

8. Process according to claim 1, in which the catalyst of stage b) comprises platinum, and said stage b) is carried out at a temperature of between 200 and 350° C.

9. Process according to claim 1, in which the catalyst of stages a) and/or b) comprises nickel, and the nickel content is between 15 and 60% by weight of metal nickel relative to the total catalyst weight.

10. Process according to claim 1, in which the catalyst of stages a) and/or b) comprises platinum, and the platinum content is between 0.05 and 2% by weight of metal platinum relative to the total catalyst weight.

11. Process according to claim 1, in which the catalyst for hydrogenation of stages a) and b) comprises the same metal that is selected from among nickel and platinum, and the metal content of the catalyst of stage b) is less than that of the catalyst of stage a).

12. Process according to claim 1, in which the catalyst of stages a) and/or b) also comprises at least one metal that is selected from among palladium, iridium, molybdenum, and tungsten.

13. Process according to claim 12, in which the content of palladium or iridium, expressed in terms of metal palladium or metal iridium, is between 0.05 and 2% by weight relative to the total catalyst weight.

14. Process according to claim 12, in which the content of molybdenum or tungsten, expressed in terms of oxide, is between 0.5 and 10% by weight relative to the total catalyst weight.

15. Process according to claim 1, further comprising carrying out a stage for intermediate separation of the partially-hydrogenated hydrocarbon feedstock in liquid form and gas from the effluent that is obtained from stage a), and wherein the liquid fraction that is obtained from the intermediate separation is treated in stage b).

16. Process according to claim 1, further comprising carrying out a stage for intermediate distillation of the partially-hydrogenated feedstock that is obtained from stage a) which is carried out in such a way as to separate a first fraction that has a boiling point of between the boiling point of the hydrocarbons with five carbon atoms and $T_x$° C., and a second fraction that has a boiling point that is higher than $T_x$° C., with $T_x$ between 150 and 250° C., and the second fraction is treated in stage b).

17. Process according to claim 1, in which the feedstock comprising hydrocarbons having at least five carbon atoms is selected from among a light naphtha fraction, a heavy naphtha fraction, a desulfurized complete naphtha fraction, a raffinate from a unit for extraction of aromatic compounds, a raffinate from dewaxing units, a kerosene fraction, a desulfurized diesel fuel fraction, or a catalytic reforming gasoline.

18. Process according to claim 1, in which the ratio between the superficial mass flow rate of the liquid partially-hydrogenated feedstock and the superficial mass flow rate of gas (Ul/Ug) at the inlet of the reactor is between 70 and 300.

19. Process according to claim 1, in which the catalyst of stage b) comprises nickel, and the mean diameter of the nickel particles measured by magnetic granulometry is between 20 angstroms and 60 angstroms.

20. Process according to claim 1, further comprising:

a stage for intermediate separation of the partially-hydrogenated hydrocarbon feedstock in liquid form and gas from the effluent that is obtained from stage a), and a stage for intermediate distillation of the partially-hydrogenated feedstock in liquid form that is obtained from the intermediate separation stage, which is carried out in such a way as to separate a first fraction that has a boiling point of between the boiling point of the hydrocarbons with five carbon atoms and $T_x$° C., and a second fraction that has a boiling point that is higher than $T_x$° C., with $T_x$ between 150 and 250° C., wherein the second fraction from the intermediate distillation is treated in stage b).

* * * * *